US005833029A

United States Patent [19]

Berish

[11] Patent Number: 5,833,029

[45] Date of Patent: Nov. 10, 1998

[54] PUMP JACK POLE ASSEMBLY

[75] Inventor: Robert P. Berish, Sharon, Mass.

[73] Assignee: Quality Steel Products, Inc., Stoughton, Mass.

[21] Appl. No.: 940,155

[22] Filed: Sep. 29, 1997

[51] Int. Cl.[6] ..... E04G 1/20

[52] U.S. Cl. ..... 182/136

[58] Field of Search ..... 182/136, 87, 145; 52/717.03, 717.05, 718.05, 718.02, 716.1, 716.5, 716.6

[56] References Cited

U.S. PATENT DOCUMENTS

| | | | |
|---|---|---|---|
| 550,175 | 11/1895 | Holden . | |
| 1,476,509 | 12/1923 | Hart . | |
| 1,714,044 | 5/1929 | Pedersen . | |
| 2,240,682 | 5/1941 | Weinstein | 304/30 |
| 2,263,063 | 11/1941 | Allen . | |
| 4,028,856 | 6/1977 | Dalbec . | |
| 4,223,507 | 9/1980 | Mascaro | 52/730 |
| 4,382,488 | 5/1983 | Anderson | 182/136 |
| 5,042,615 | 8/1991 | Anderson | 182/136 |

FOREIGN PATENT DOCUMENTS

| | | |
|---|---|---|
| 1197532 | 7/1958 | France . |
| 422259 | 4/1967 | Switzerland . |

*Primary Examiner*—Alvin Chin-Shue
*Attorney, Agent, or Firm*—Pandiscio & Pandiscio

[57] ABSTRACT

A pump jack pole assembly includes a rigid elongated tubular member having a planar front wall surface, an elongated elastomeric strip having a flat rear surface disposed adjacent the tubular member front wall surface and a front surface having grooves therein extending lengthwise of the strip, a retainer plate in each of the grooves, each of the plates having a thickness less than the depth said grooves so that the front surfaces of the plates are recessed in the strip front surface, and screws for releasably fixing the plates in the grooves and the elastomeric strip to the tubular member front wall, the heads of the screws being recessed in the plates.

28 Claims, 4 Drawing Sheets

PUMP JACK POLE ASSEMBLY

BACKGROUND OF THE INVENTION

1. Field of the Invention

The invention relates to scaffolding equipment and is directed more particularly to a pole for use in conjunction with a pump jack which carries staging up and down.

2. Description of the Prior Art

The use of scaffolding to permit workers, such as painters, brick layers, carpenters, siding installers, and the like, to work at elevated levels is well known. It is also known to use pump jack poles which are spaced from each other and are adjacent a surface to be worked on as, for example, a wall of a building. Pump jacks, which support scaffolding staging, clamp onto the poles and are operative to ride up and down the poles and carry the scaffolding on which the workers stand. Typically, a workman operates the pump jack by means of a foot pump to move the staging up and down the pole.

U.S. Pat. No. 4,223,507, issued Sep. 23, 1980 to Thomas E. Mascaro, shows a composite pole for use with a pump jack that has a wood facing on two opposite sides of a hollow aluminum member that is held in place by bolts and nuts.

In U.S. Pat. No. 4,382,488, issued May 10, 1983, to Carl Anderson, there is shown and described a pole for use with pump jacks that is formed of metal tubing and has a facing on one side that is made of a rubberized conveyor belting material. The rubberized belting material consists of a cotton or nylon base (or carcass or backing) impregnated and coated with rubber. The rubberized belting material is secured to the face of the metal pole by adhesive and/or rivets. Securement of the rubberized material to the metal wall of the tubular pole must be reliable to support the weight of workers standing on the staging with the shackles of the pump jack gripping the rubberized surface by the pole. In the aforementioned patent, it was shown that although the shackles of the pump jack clamp the pole on two opposing sides, only one side of the pole needs to be covered by the rubberized belting material to provide adequate gripping of the pole and support the weight of workers on the scaffolding staging.

Due to substantial transmittal forces acting on the rubberized material when the workers' weight is applied to the staging, the adhesive connection between the rubberized strip and the metal pole must be secure. Using rivets in addition to the adhesive connection between the rubberized material and the metal wall of the pole improves the connection between the rubber and the metal pole.

However, the use of adhesive, and the addition of rivets, renders the pole very difficult to repair in the field. That is, given the adhesive and/or rivet interconnection of pole and working surface, it is difficult, and usually virtually impossible, to replace a worn rubberized working surface with a new rubberized working surface.

In U.S. Pat. No. 5,042,615, issued Aug. 27, 1991, to Carl Anderson, there is provided a pump jack pole which comprises an elongated metal tubing and a resilient facing strip preferably consisting of a rubberized belting material which faces and is secured to an exterior surface of the metal tubing. The tubing is formed with a plurality of longitudinally extending closely spaced parallel ribs, whereas the elastomeric strip is formed with a plurality of similarly spaced longitudinally extending grooves of complementary configuration to the ribs. The ribs and the grooves are interdigitated with one another so as to provide a secure connection between the strip and the metal tubing of the pole as the strip is pressed onto the tubing.

It is said in the '615 patent, that with the interdigitated arrangement of ribs and grooves, the elastomeric strip does not peel off the pole and will not slide along the metal tubing under the weight of an individual operating a pump jack that is mounted on the pole. However, this arrangement is more costly than the arrangement shown in U.S. Pat. No. 4,382,488 and replacement of the facing strip in the field is not easy to accomplish.

It often happens that wear of the elastomeric strip is not noticed until a problem with the pole occurs in use in the field, by which time it is costly and inconvenient to send the pole out for replacement of the elastomeric working surface. Accordingly, there is a need for a composite pump jack pole in which an elastomeric strip is securely fixed to the pole, but is readily replaceable in the field by workmen with only basic tools available. There also is a need to utilize a facing strip that has a simple design so as to reduce costs and also does not require a fabric base or backing for reinforcement and shape stability purposes.

SUMMARY OF THE INVENTION

An object of the invention is, therefore, to provide a pump jack pole assembly in which the elastomeric strip is readily removable from and attached to the rigid pole.

Another object is to provide a pump jack pole having a facing strip that comprises an extruded elastomer and does not embody or require any reinforcing or stabilizing base, backing or carcass member(s).

With the above and other objects in view, a feature of the present invention is the provision of a pump jack pole assembly comprising a rigid elongated tubular member, the member having a front wall surface, an elongated elastomeric strip having a rear surface for disposition adjacent the front wall surface and a front surface having grooves therein extending lengthwise of the strip, each of the grooves having a bottom surface, a plate for disposition in each of the grooves, each of the plates having a thickness less than the depth of each groove so that the front surfaces of the plates are in a recessed relationship with the strip front surface when the plates are disposed in the grooves, and fastener means for fixing the plates in the grooves and the elastomeric strip to the tubular member front wall, the fastener means terminating short of the front surface of the elastomeric strip so as not to be engageable by shackle components of a pump jack that is mounted on the jack pole assembly.

In accordance with a further feature of the invention, there is provided a pump jack pole assembly comprising a rigid elongated tubular member, the member having a planar front wall surface, an elongated elastomeric strip having a rear surface engaged with the front wall surface and a front surface having grooves therein extending lengthwise of the strip, each of the grooves having a bottom surface, a plate disposed in each of the grooves, each of the plates having a thickness less than the depth of the groove in which it is disposed, and fastener means extending through the plates and the elastomeric strip into the tubular member front wall, whereby the fastener means secure the plates and said strip to said tubular member front wall, said fastener means having heads that are recessed relative to the elastomeric strip front surface so as not to be engageable by shackle components of a pump jack that is mounted on the pole assembly.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

Like components are identified by like numerals in the several figures.

DESCRIPTION OF THE PREFERRED EMBODIMENTS

Figure 1:
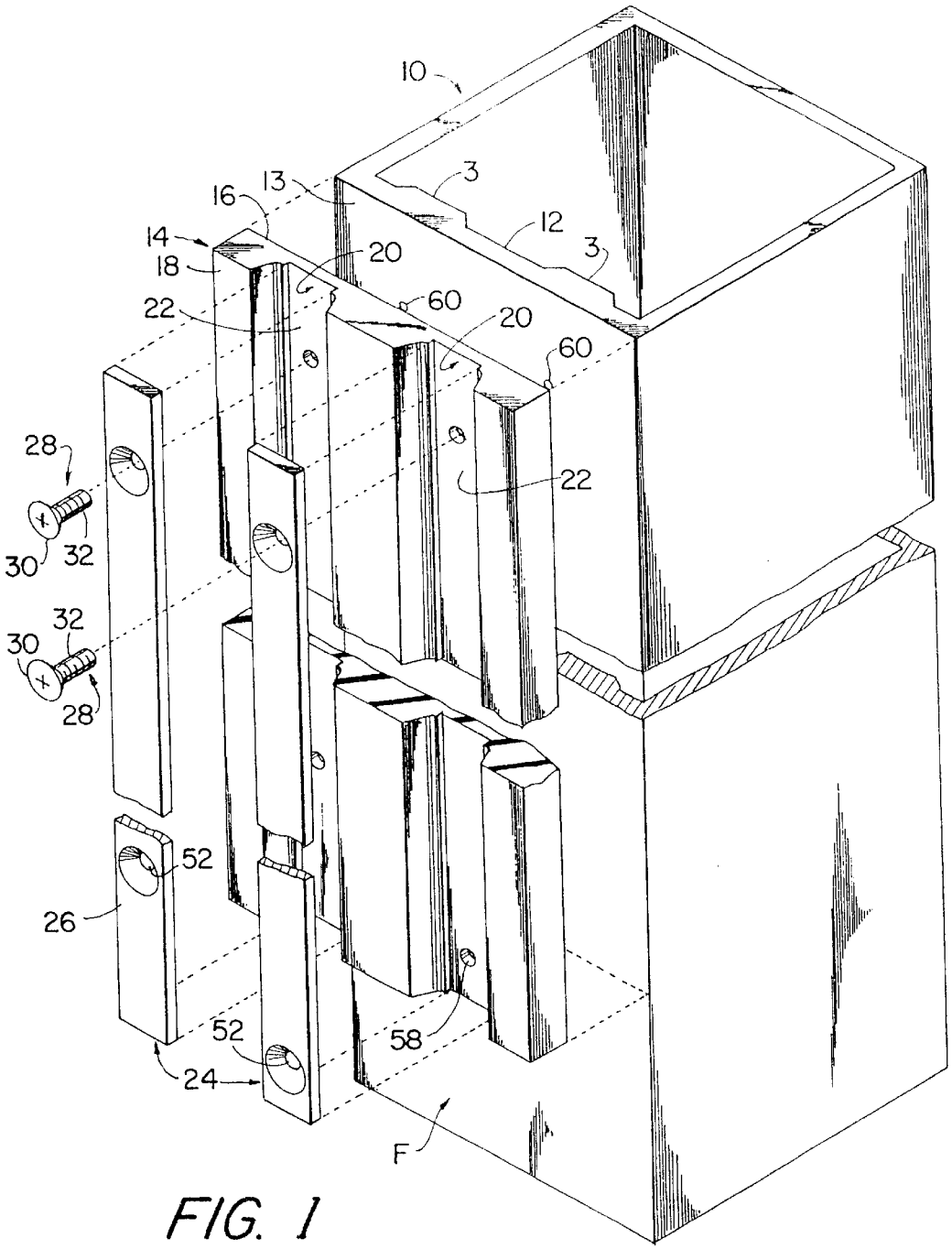
FIG. 1 is an exploded fragmentary perspective view of one form of pump jack pole assembly illustrative of an embodiment of the invention.

Referring to FIG. 1, it will be seen that the illustrative pump jack pole assembly includes a rigid elongated tubular member 10 of rectangular configuration having a front wall 12 with a planar front surface 13. The assembly further includes an elongated elastomeric strip 14 having a flat rear surface 16 for disposition adjacent the front wall 12, and a front surface 18 having grooves 20 therein extending lengthwise of the strip 14. Each of the grooves 20 is provided with a bottom surface 22. Preferably but not necessarily, strip 14 has two like and parallel grooves 20.

Figure 3:
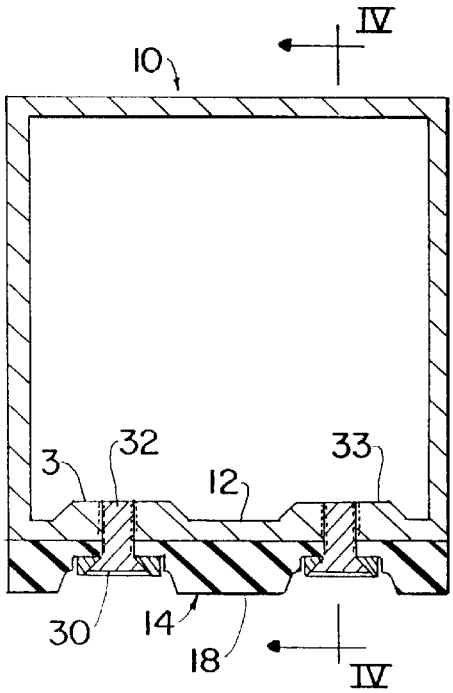
FIG. 3 is a cross-sectional view taken along line III—III of FIG. 2.

A retainer plate 24 is provided for disposition in each of the grooves 20. Plates 24 are preferably made of aluminum or stainless steel. The thickness of each plate 24 is less than the depth of grooves 20 (i.e., the distance T in FIG. 5 from the groove bottom surface 22 to the strip front surface 18, so that the front surfaces 26 of the plates 24 are spaced from the front surface 18 of the elastomeric strip 14 in a recessed relationship when the plates 24 are disposed in the grooves 20, as shown in FIG. 3. Fastener means are provided for fixing the retainer plates 24 in the grooves 20, so as to secure the elastomeric strip 14 to the tubular member front wall 12. The fastener means preferably comprise screws 28 having heads 30 and threaded shanks 32. The fasteners are sized so that when they are secured to the pole member 10, their heads are flush with the front surfaces 26 of plates 24 or recessed a short distance below surfaces 26. Thus, only portions of the elastomeric strip front surface 18 bordering the retainer plates are exposed for engagement by the pump jack (not shown).

Referring to FIGS. 1 and 3, it will be seen that the rigid elongated tubular member 10 preferably is rectangularly shaped in cross-section and its front wall 12 is thickened at selected locations to form longitudinally-extending ribs 33. The thickened rib sections are designed to assure adequate wall strength to secure fasteners 28. Preferably, tubular member 10 is made of metal, although it may be made of some other material, having adequate strength, e.g., a composite having a metal or plastic matrix. Preferably member 10 is an aluminum extrusion. In practice, it is preferred that the rectangular tubular poles 10 measure about 3 inches wide on each side. In the case of an aluminum pole, it is preferred that the walls be about 0.125 to about 0.150 inch thick, but increased to about 0.25 inch at ribs 32. The tubular members may be made in selected lengths. In practice, it is preferred that they be made in lengths of about 6'4"; 12'4"; and 24'2.5".

Referring again to FIGS. 1 and 3, it will be seen that the elastomeric strip 14 has a width substantially equal to the width of tubular member front wall 12, that is, a width of about three inches. The strip preferably is about 0.375 inch thick. The grooves 20 are parallel to one another and to side edges 34, with the depth of grooves 20 being about 0.250 inch, so that the base of each groove 20 has a thickness of about 0.125 inch. Preferably, the strip 14 is an extruded ethylene- propylene rubber ("EPM") of about 85–90 durometer. Alternatively, strip 14 may be an extruded ethylene-propylene rubber modified by the addition of a diene monomer (a so-called "EPDM" rubber). Still other elastomeric materials known to persons skilled in the art may be acceptable substitutes for the EPM and EPDM rubbers.

The strip 14 may comprise a single strip having a length of a few inches less than the length of the tubular member 10 to which it is to be fixed. Preferably, the strip 14 is 3–5 inches less than that of tubular member 10. For example, in practice it has been found appropriate to provide elastomeric strips of lengths of about 5'11"; 11'11" and 23'9.5" for attachment, respectively, to tubular member lengths having the lengths described above of 6'4", 12'4", and 24'2.5". The reason for the difference in lengths between the tubular members and the elastomeric strips is so that one end of the elastomeric strip 14 may be fixed coincident with one end of the tubular member 10, while the other end of the elastomeric strip is spaced from the other end of the tubular member (FIGS. 1, 2 and 4) by about 5 inches, for reasons to be discussed hereinafter.

Figure 6:
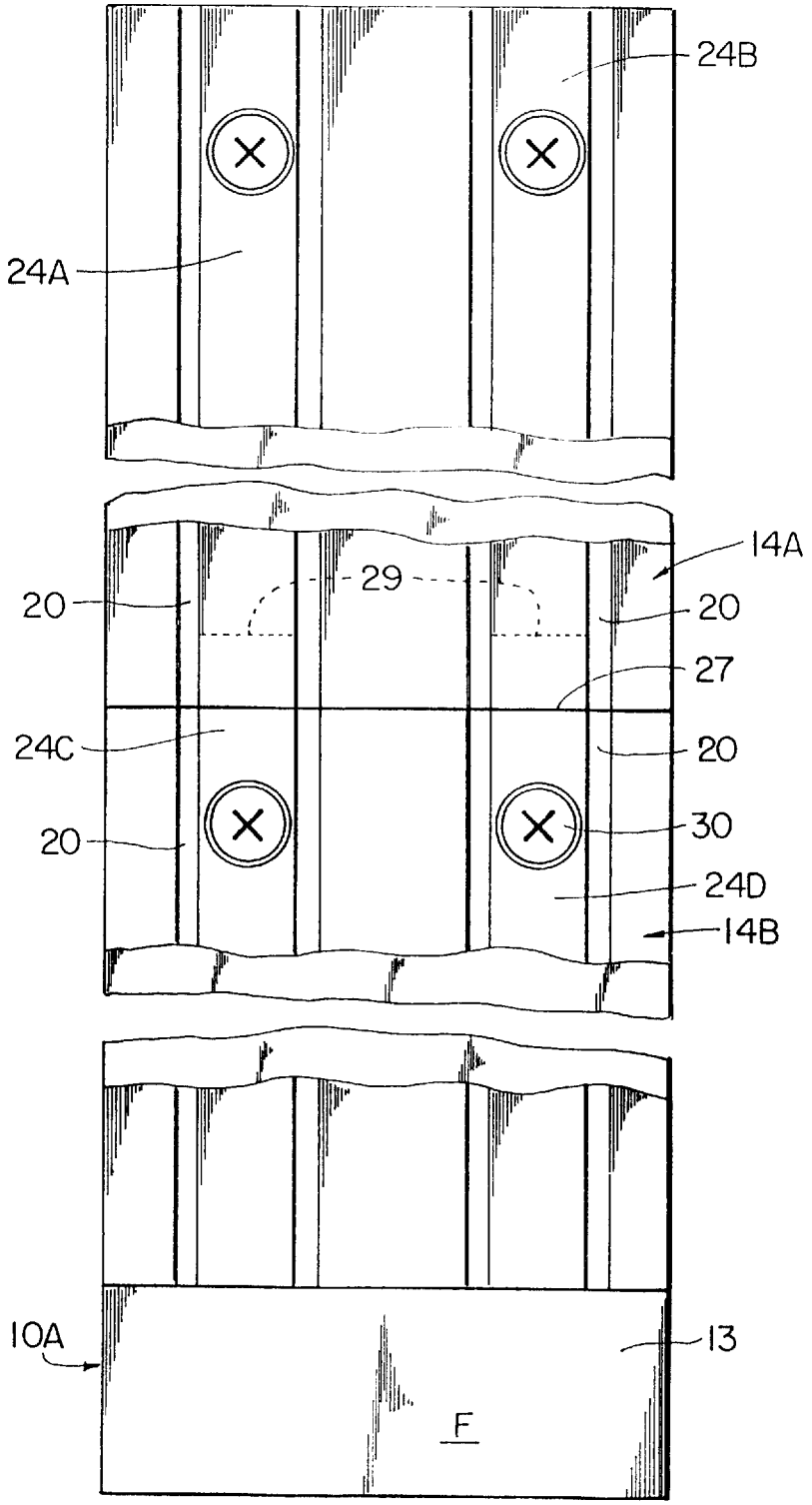
FIG. 6 is similar to FIG. 2 but illustrative of an alternative embodiment.

Alternatively to having a single elastomeric strip of a length almost equal to the length of the tubular member, the elastomeric strip may be provided in discrete increments or sections sized so that two or more sections are required to span the length of a tubular member. For example, as shown in FIG. 6, two elastomeric sections 14A and 14B are sized and positioned end-to-end to cover the front surface 13 of a 12'4" long tubular member 10A. The elastomer sections abut one another at line 27. Similarly four such sections would be required for a 24'2.5" long tubular member. In FIG. 6, four retainer plates 24A, B, C, D are shown with the plates 24A and 24B abutting plates 24C and 24D respectively at line 27.

Figure 5:
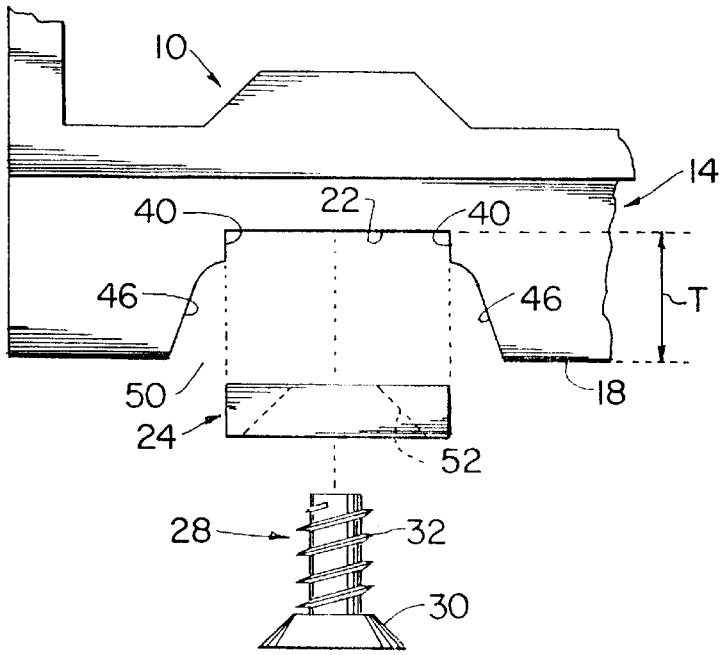
FIG. 5 is an enlarged exploded view of a portion of FIG. 3.

Referring to FIG. 5, it is preferred that each groove 20 include the aforementioned bottom surface 22 and a pair of opposed side surfaces that comprise right angle bottom or inner portions 40, that cooperate with the bottom surface 22 to define a rectangular cross-sectional configuration for the bottom of the groove, and top or outer portions 46, that are slanted outwardly to form a beveled or flared opening 50 for groove 20. In the preferred embodiment of this invention, the rectangular bottoms of grooves 20 are about 0.55 inch wide.

The retainer plates 24 preferably are made of metal and have a thickness of about 0.125 inch and a width of about 0.50 inch. Plates 24 are provided with tapered holes 52 for receiving the heads 30 of flat head screws 28. The smallest diameter of each hole 52 is slightly greater than that of the shanks 58 of screws 30. The heads 30 of the screws 28 are received wholly within the tapered holes 52. Preferably holes 52 and screw heads 30 are sized so that when the screws are fully secured in place, the screw heads 30 sit below the level of plates 24 as shown in FIG. 3. The elastomeric strip 14, and front wall 12 of tubular member 10 are also provided with holes 58, 60 (FIG. 1) for receiving the screws 30. Holes 58 are centered in grooves 20 and holes 60 are formed in the region of ribs 33.

Since it is preferred to use tubular members 10 made of aluminum, it is preferred to use screws made of stainless steel so as to avoid a galvanic reaction between the screws and the metal tubular member 10 of the type that tends to cause the screws to "freeze" in place due to corrosion. However, screws made of other materials also may be used if concern about fastener "freezing" or corrosion is of little concern. Preferably the screws 28 are self-tapping, in which case the screw holes 60 are sized so as to enable the screws to tap their way into the tubular member front wall and ribs 32. Preferably the holes 58 in the rubber strip 14 are slightly oversized with respect to the shanks of screws 28.

In assembly, the plates 24 are placed in the rectangular bottom portions of the elastomeric strip grooves 20. The screws 28 are inserted into the plate screw holes 52 and holes 58 of the rubber strip and then, with the elastomeric strip 14 positioned adjacent the tubular member front wall surface 13, screws 30 are screwed into holes 60 in the tubular member front wall 12. Inasmuch as the plate thickness (0.125 inch) is substantially less than the depth (0.25 inch) of the grooves 20, the plate front surface 26 and the screw heads 56 are removed from (i.e. are in a recessed relation to) the front surface 18 of the elastomeric strip 14, so that there is no risk of the metal strip or the screw heads being engaged by gripping components of the shackles of a pump jack mounted on the pole assembly. As a result, the elastomeric strip front surface 18 is fully available for engagement by shackle portions of a pump jack (not shown).

The beveled or flared opening 50 of the grooves 20 insures that the elastomeric strip does not cave in, i.e., is not distorted over the plates 24 when compressed by a pump jack, thereby avoiding or substantially eliminating possible abrasion and cutting of the rubber strip 14 by sharp edges of the plates.

Figure 2:
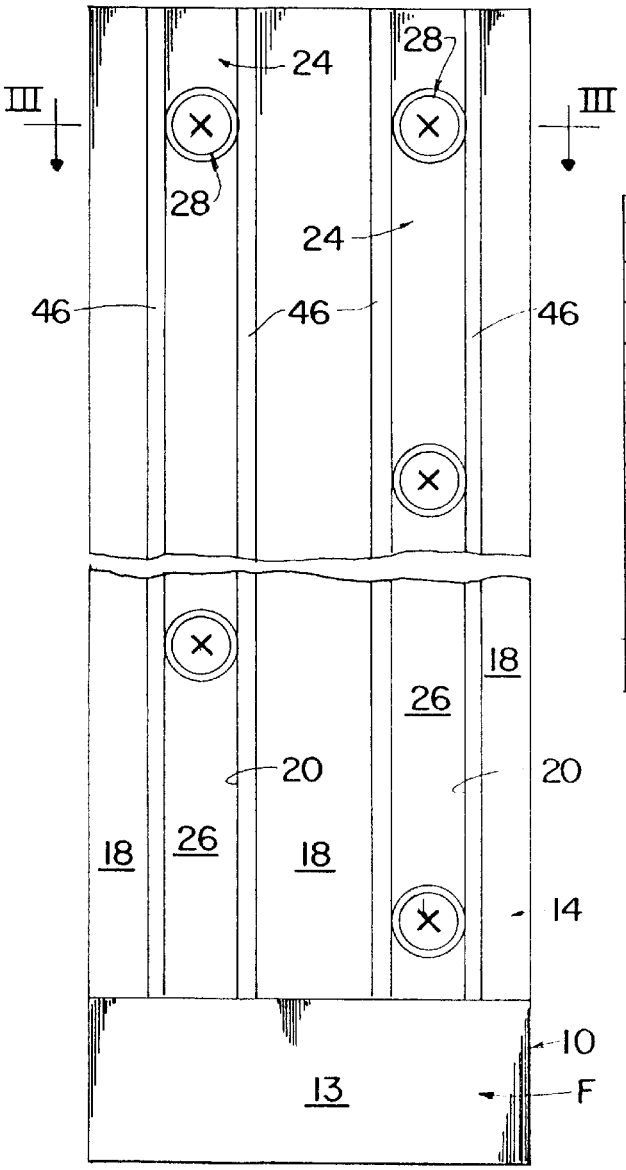
FIG. 2 is a fragmentary front elevational view thereof.
Figure 4:
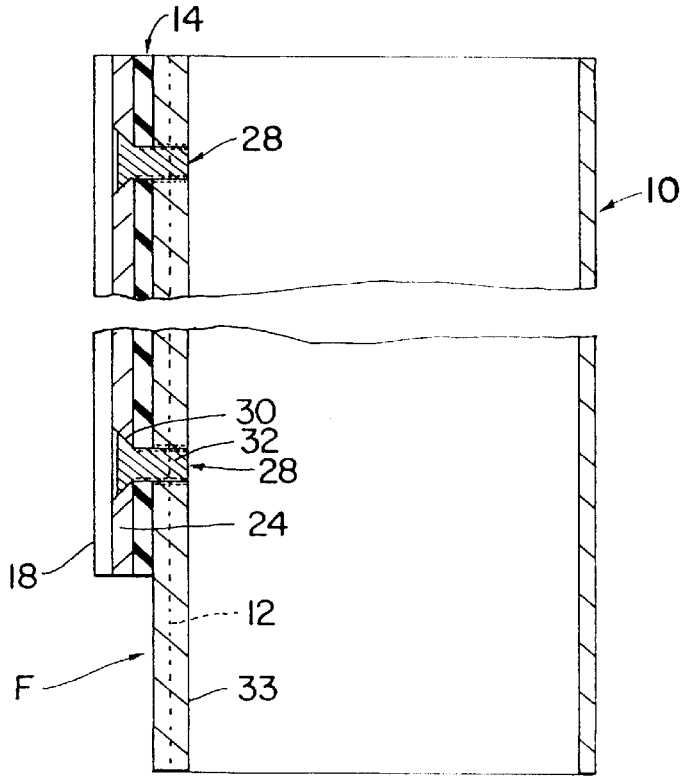
FIG. 4 is a longitudinal sectional view taken along line IV—IV of FIG. 3.

As noted above, it is preferred that the tubular member 10 and elastomeric strip 14 be of lengths permitting about three to five inches of the tubular member 10 at one end thereof to be free of elastomeric strip (as shown by area F in FIGS. 1, 2 and 4). In extending the reach of the scaffolding, the tubular members are joined end-to-end by means known in the art. The presence of the elastomeric strip at each end of a juncture permits such end-to-end juncture of tubular members without interruption of the elastomeric surface. In other words, the elastomeric strip 14 of one tubular member is disposed in close abutting relation with the elastomeric strip 14 of the adjacent tubular member. Limiting the length of elastomeric strip 14 so that it terminates short of one end of the associated tubular metal member is advantageous in that the pole assembly is self-limited to no more than two tubular members being joined together, thereby limiting the height to which the tubular members may be extended, so as to prevent any attempt at unsafe heights.

In operation, when it is noticed that an elastomeric strip 14 has become worn, the strip may be removed with a screw driver and replaced with a new strip. This is particularly advantageous in the case of the alternative embodiment, wherein a plurality of elastomeric strip segments are mounted end-to-end on a tubular member, and only one elastomeric strip segment which shows wear needs to be replaced. By using stainless steel screws with aluminum poles and steel or aluminum retainer plates, the likelihood that the screws will become "frozen" in place by galvanic corrosion is eliminated, thereby assuring that screws 30 may be removed without difficulty in the field.

There is thus provided a pump jack pole assembly which facilitates ready removal and replacement of the elastomeric strip in the field by workmen on the scene utilizing a screw driver. It also has been determined that elastomeric strips as described herein are durable and also provide the gripping action required to lock a pump jack in a selected portion on the pole, thereby eliminating the need to use a rubberized belting material as required by U.S. Pat. No. 4,382,488.

It is to be understood that the present invention is by no means limited to the particular construction herein disclosed and/or shown in the drawings, but also comprises any modification or equivalents within the scope of the claims. Thus, for example, the arrangement shown in FIG. 6 may be modified by having serially adjacent retainer plates 24A, C (or 24B, D) meet at a line 29 that is offset from the junction line 27 of two serially adjacent facing strips 14A and 14B. Also the dimension of strips 14 and plates 24 may be altered with critically affecting the invention. Still other changes will be obvious to persons skilled in the art.

What is claimed is:

1. A pump jack pole assembly comprising:

a rigid elongated tubular member made of metal, said member having a front wall with a front surface;

at least one elongated elastomeric strip having a rear surface for disposition adjacent said front wall surface and a front surface characterized by at least two grooves therein extending lengthwise of said strip parallel to one another and to the opposite side edges of said elastomer strip, each of said grooves having a bottom surface;

a retainer plate for disposition in each of said grooves, each of said retainer plates having a front surface and a rear surface with the thickness of each retainer plate measured between its said front and rear surfaces being less than the distance from said groove bottom surface to said strip front surface, such that said retainer plates are spaced from said strip front surface when said retainer plates are disposed in said grooves; and a plurality of fasteners for fixing said retainer plates in said grooves and said elastomeric strip to said tubular member front wall, each of said fasteners extending through holes in said retainer plates into said front wall of said tubular member and terminating short of said elastomeric strip front surface.

2. The assembly in accordance with claim 1 wherein said tubular member has a rectangular cross-sectional configuration.

3. The assembly in accordance with claim 1 wherein said retainer plates are made of metal.

4. The assembly in accordance with claim 1 wherein said tubular member front wall is provided with elongated ribs subtending said grooves and said fasteners extend into said ribs.

5. The assembly in accordance with claim 4 wherein said front surface of said front wall of said tubular member is planar.

6. The assembly in accordance with claim 1 wherein said elastomeric strip has a width substantially equal to the width of said front surface of said front wall.

7. The assembly in accordance with claim 1 wherein said grooves have substantially identical widths.

8. The assembly in accordance with claim 6 wherein said elastomeric strip is made of an ethylene propylene rubber.

9. The assembly in accordance with claim 1 wherein said strip consists of a rubber having a durometer of about 85–90.

10. The assembly in accordance with claim 1 wherein each of said grooves comprises a bottom section of rectangular cross-sectional shape and an outer section that is flared in cross-section, with the width of said outer section being narrowest immediately adjacent said bottom section.

11. The assembly in accordance with claim 1 having an elastomeric strip end portion that is spaced from an adjacent end of said pole by a selected distance of 3–5 inches.

12. The assembly in accordance with claim 3 wherein said retainer plates are made of stainless steel or aluminum.

13. The assembly in accordance with claim 1 wherein said fasteners comprise screws.

14. The assembly in accordance with claim 13 wherein said screws have conically tapered heads and said retainer plates have holes that are tapered conically away from said elastomeric strip and are sized to fully accept the heads of said screws.

15. The assembly in accordance with claim 13 wherein said screws are made of stainless steel.

16. The assembly in accordance with claim 13 wherein said screws are self-tapping in said tubular member.

17. The assembly in accordance with claim 13 wherein said elastomeric strip and said retainer plates are fastened to said pole only by said screws, whereby said strip and said plates are released from said pole by removal of said screws.

18. The assembly in accordance with claim 1 comprising a plurality of said elastomeric strips mounted end-to-end on said tubular member.

19. The pole assembly of claim 1 wherein first and second elastomer strips each have a beveled end surface, with the beveled end surface of said first elastomer strip overlapping and engaging the beveled end surface of said second elastomer strip.

20. The assembly in accordance with claim 10 wherein said retainer plates reside in said bottom sections of said grooves.

21. A pump jack pole assembly comprising:

a rigid elongated tubular member made of metal and having a wall with a planar outer surface;

an elongated elastomeric strip that is formed with a flat rear surface and a front surface, said flat rear surface being engaged with said planar outer surface of said tubular member and said front surface having at least one groove with a flat bottom surface;

a retainer plate disposed in said at least one groove, said retainer plate having a front surface and a thickness less than the depth of said at least one groove so that its said front surface is spaced from said strip front surface; and screws extending through said retainer plate and said elastomeric strip and screwed into said wall of said tubular member, whereby said screws secure said retainer plate and said elastomeric strip to said tubular member.

22. A pump jack pole assembly according to claim 21 wherein said retainer plate is made of metal.

23. A pump jack pole assembly comprising:

a rigid elongated tubular metal member having a rectangular cross-section, said tubular member including a longitudinally-extending wall having a flat outer surface;

at least two elongated elastomer strips overlying and disposed end-to-end lengthwise along said outer surface of said wall of said tubular member, each of said strips having a rear surface and a front surface, with said rear surfaces of said strips engaging said outer surface of said wall and said front surfaces of said strips each having at least two parallel grooves therein extending lengthwise of said strips, each of said grooves having a flat bottom surface and the grooves in one strip being aligned with the grooves in an adjacent strip;

at least one flat metal retainer plate disposed in and extending lengthwise of each of said grooves, each of said retainer plates having a front surface and a rear surface with said rear surface engaged with said flat bottom surface of the groove in which it is disposed, said retainer plates having a thickness measured between said front and rear surfaces that is less than the depth of said grooves, whereby said front surfaces of said retainer plates are spaced from said front surfaces of said strips; and a plurality of fasteners extending through said retainer plates and said strips into said longitudinally-extending wall so as to secure said plates and said strips to said tubular member, said fasteners having heads located between the planes of said elastomeric strip front and rear surfaces.

24. The pole assembly of claim 23 wherein said grooves are characterized by bottom portions and flared outer portions, and said retainer plates reside substantially entirely within said bottom portions of said grooves.

25. The pole assembly of claim 24 wherein said fasteners are screws having conical heads and threaded shanks attached to said heads, and said retainer plates are formed with conical holes that are sized and shaped to accommodate said shanks and serve as seats for said fastener heads.

26. The pole assembly of claim 25 wherein said tubular material member is made of aluminum, said retainer plates are made of aluminum or steel, and said screws are made of stainless steel.

27. The pole assembly of claim 23 wherein said tubular member is made of aluminum, said retainer plates are made of aluminum or steel, and said fasteners are stainless steel screws that are screwed into said wall of said tubular member.

28. The pole assembly of claim 23 wherein at least one of said plates overlies mutually confronting end portions of two adjacent elastomeric strips.

* * * * *